United States Patent [19]

Shirlin et al.

[11] Patent Number: 5,001,946

[45] Date of Patent: Mar. 26, 1991

[54] ROOF SHINGLE STRIPPING APPARATUS

[76] Inventors: Jack W Shirlin, 3170 Sheridan, Garden City, Mich. 48135; Robert T. Kaiser, 6975 Waverly, Dearborn, Mich. 48127

[21] Appl. No.: 478,828

[22] Filed: Feb. 12, 1990

[51] Int. Cl.[5] ..... B25B 33/00

[52] U.S. Cl. ..... 81/45; 30/169

[58] Field of Search ..... 81/45, 46; 30/169, 170; 15/93 R; 299/37

[56] References Cited

U.S. PATENT DOCUMENTS 4,663,995 5/1987 Amundson et al. ..... 81/45

4,709,479 12/1987 Lavelette ..... 30/170

4,763,547 8/1988 Dike ..... 81/45

*Primary Examiner*—James G. Smith

*Attorney, Agent, or Firm*—Charles W. Chandler

[57] ABSTRACT

Apparatus for removing roof shingles includes an elongated body having a handle at the upper end and a pivotally connected lift plate at the lower end. A piston and cylinder actuator mounted on the body and activated by a trigger mounted on the handle. A lift plate is pivotally mounted on the lower end of the body. A toggle linkage connects the actuator to the lift plate for pivoting the forward edge of the plate about a heel structure under the lift plate.

8 Claims, 2 Drawing Sheets

ROOF SHINGLE STRIPPING APPARATUS

BACKGROUND OF THE INVENTION

This invention is related to apparatus for striping roof shingles and nails.

Roof shingles are difficult to remove from an existing roof. The shingle nails are also very difficult to remove.

Conventionally, roofers employ a shovel or other hand tool which is inserted beneath a shingle or nail. The shovel is pivoted to raise the shingle and the nails. This is a very difficult and time-consuming process. Some power operated roof striping devices are known in the prior art. These include U.S. Pat. No. 4,663,995 which issued May 12, 1987 to Frank M. Amundson; Herbert C. Manners; and Paul M. Jeffries; and U.S. Pat. No. 4,763,547 which issued Aug. 16, 1988 to John H. Dike, Jr.

SUMMARY OF THE INVENTION

The broad purpose of the present invention is to provide an improved power-operated, roof stripping apparatus. The preferred embodiment of the invention, which will be described in greater detail, comprises an elongated body having a handle at its upper end and a lift plate pivotally connected to its lower end. The lift plate has a relatively thick heel mounted beneath the pivotal connection to the body, generally parallel to the leading edge of the lift plate. The leading edge is that portion inserted beneath a shingle or a nail for raising it.

The arrangement is such that after inserting the lift plate beneath a shingle, the user can manually raise the shingle either by swinging the handle about the heel, or triggering the piston and cylinder actuator to pivot the lift plate about the heel, or, a combination of both efforts.

The piston and cylinder actuator is connected by a toggle linkage to the rear edge of the lift plate. A toggle linkage provides a greater mechanical advantage for employinq the power of the piston-cylinder actuator compared to prior art devices known to us.

The preferred apparatus is relatively inexpensive to manufacture, light weight and extremely effective.

Still further objects and advantages of the invention will become readily apparent to those skilled in the art to which the invention pertains upon reference to the following detailed description.

THE DESCRIPTION OF THE DRAWINGS

The description refers to the accompanying drawings in which like reference characters refer to like parts throughout the several views, and in which.

DESCRIPTION OF THE PREFERRED EMBODIMENT

Figure 3:
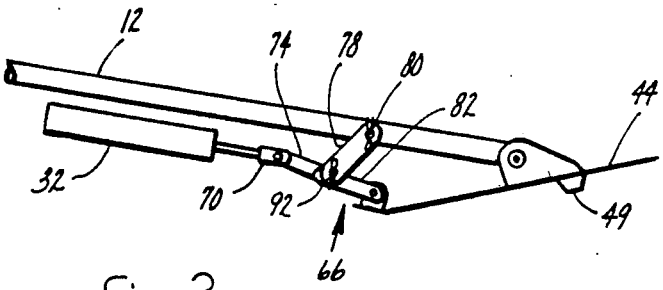
FIGS. 3–4 illustrate the power-operated apparatus employed for pivoting the lift plate with respect to the lower end of the body.
Figure 4:
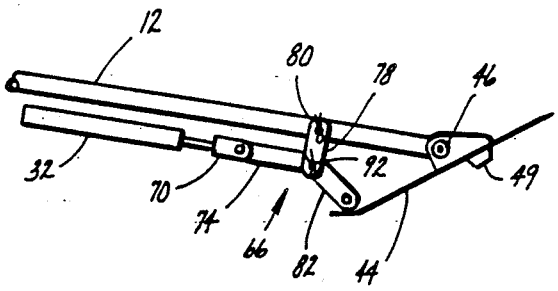
Figure 1:
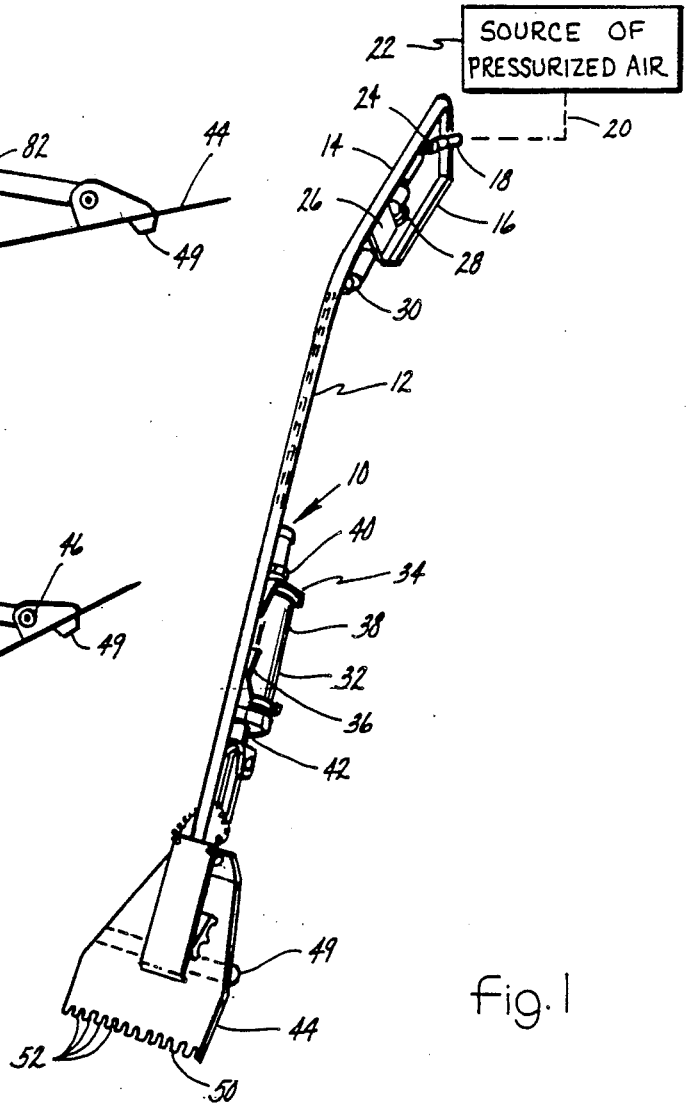
FIG. 1 is a perspective view of a shingle stripping apparatus illustrating the preferred embodiment of the invention.
Figure 2:
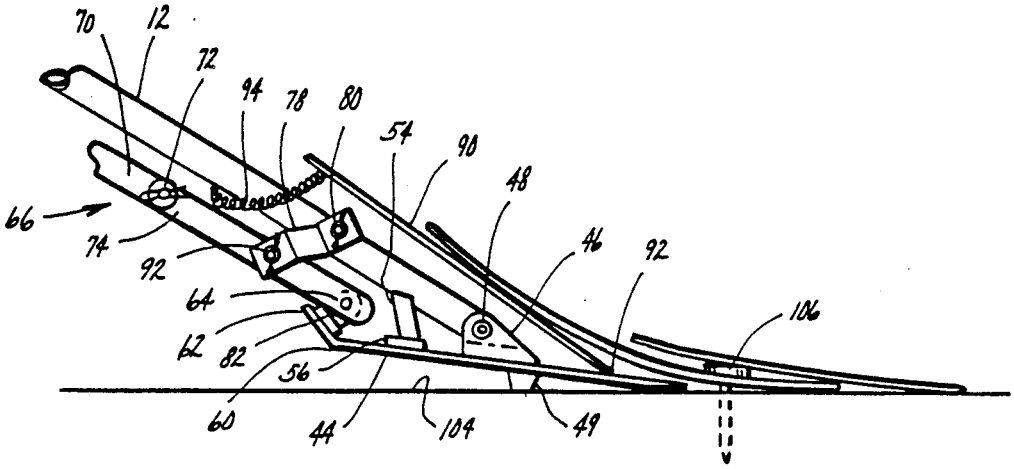
FIG. 2 is a view of the preferred apparatus being inserted beneath a shingle for manually raising the shingle and a nail.
Figure 6:
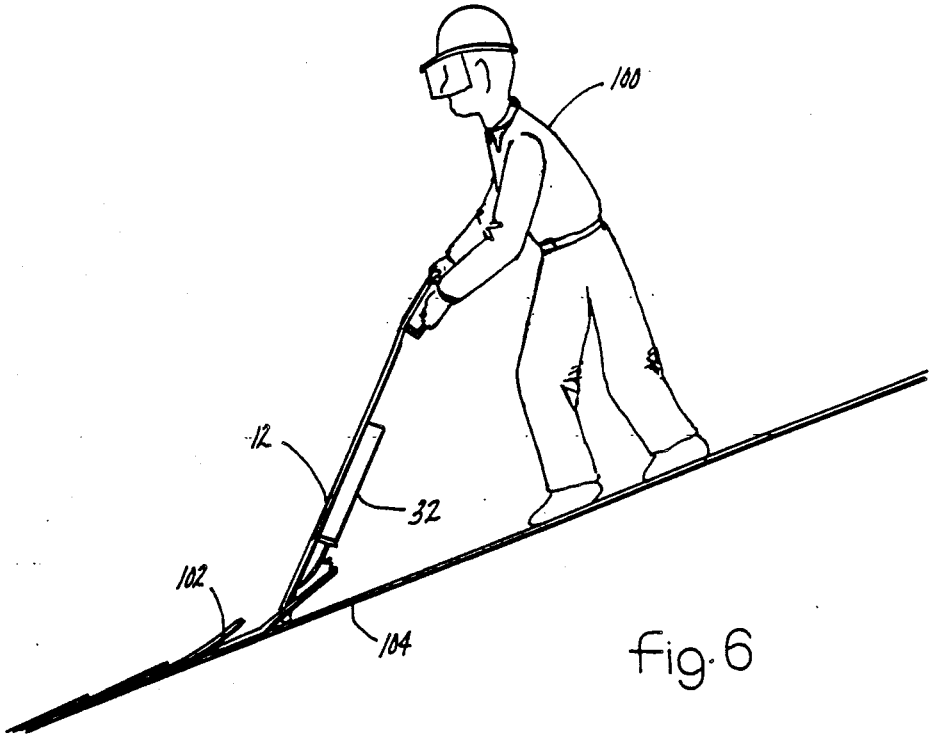
FIG. 6 is a view generally illustrating the manner in which the preferred apparatus is used for removing shingles from a sloping roof.
Figure 5:
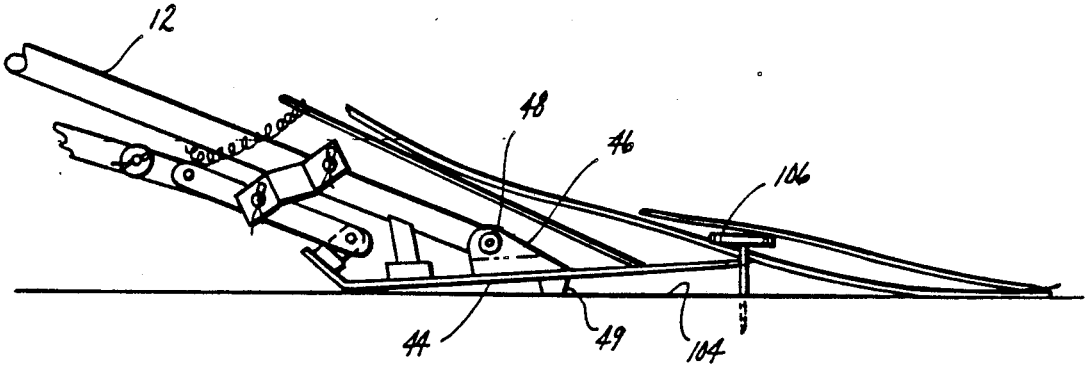
FIG. 5 is a view similar to FIG. 2 but in which the nail has been raised.

Referring to the drawings, FIG. 1 illustrates a roof shingle stripping apparatus 10. Apparatus 10 comprises an elongated tubular body 12 having its upper end 14 bent to form a handle. A "U" shaped guard 16 has its ends attached to handle 14. A threaded fitting 18 is mounted on the guard and connected by conduit means 20 to a source of pressurized air 22.

Fitting 18 is connected by a conduit 24 to a conventional pneumatic pneumatic valve 26 having a trigger 28 for opening and closing communication with source 22. A conduit 30 is connected to the outlet of valve 26 and is disposed inside tubular body 12, as is illustrated in phantom.

A piston and cylinder actuator 32 is mounted by a pair of brackets 34 and 36 on body 12. The cylinder 38 of the actuator is parallel to the length of the body. The lower end of conduit 30 is connected by a fitting 40 to the upper end of the actuator. The actuator has an internal piston (not shown) connected to a piston rod 42 in such a manner that when trigger 28 is squeezed by the user, the piston rod is extended from the cylinder. When the trigger is released, the piston rod is retracted as the pressurized air is exhausted from the cylinder.

Lift plate 44 has a pair of spaced lugs 46. A pivot pin 48 pivotally connects the lower end of body 12 to lugs 46.

The lift plate preferably has a leading edge 50 about 8½" wide forming an edge that is generally parallel to the axis of rotation of body 12 with respect to the lift plate. The lift plate is formed of a heavy-gauge plate-like steel. The lift plate has a plurality of open-ended slot means 52, each adapted to receive a nail when the lift plate is inserted beneath the nail head. The leading edge of the lift plate is somewhat beveled to assist insertion beneath a shingle.

Pivot pin 48 is mounted about 5" behind the lift plate leading edge.

A rod-like heel 49 is about ⅝" in diameter, is welded to the lower surface of the lift plate parallel to the leading edge 50, in a location between pivot pin 48 and the leading edge.

A stop structure 54 is welded to the lower side of body 12 to form an abutment with a small plate 56 mounted on the upper surface of the lift plate when body 12 has been swung around the pivot pin toward the rear edge of the lift plate at an angle of about 30° with respect to the plane of the lift plate.

The lift plate is bent at 60 to form a rear edge 62. A pivot pin 64 is mounted on rear edge 62.

A toggle linkage 66, generally indicated at 66, is mounted between pivot pin 64 and piston rod 42. Toggle linkage 66 includes a clevis 70 mounted on the end of the piston rod. A pin 72 pivotally connects the clevis to a link 74. A pair of link means 78 are connected by pin means 80 to body 12. A pair of link means 82 are mounted on pivot pin 64. Pivot means 92 connect the ends of link 74, link means 78 and link means 82 together in such a manner that as the piston rod is extended, link 74 pushes link means 78 with respect to link means 82 so that they unfold to pivot the rear edge of the lift plate away from body 12. When the piston rod is retracted, link 74 pulls link means 78 and 82 so as to slightly fold link means 78 with respect to link means 82 together to move the rear edge of the lift plate toward the body.

A shingle or a nail may be lifted by inserting the leading edge of the lifting plate beneath the shingle or other roofing structure, squeezing the trigger to actuate the cylinder and thereby cause the toggle linkage to unfold and apply a substantial lifting force on the leading edge of the lift plate.

A sheet metal shield 90 has a lower end connected at 92 between the pivot 48 and the leading edge of the lift plate. Shield 90 is somewhat resilient. A coil spring 94 has its ends attached to the shield and its midsection wrapped around body 12 to provide means for deflecting a shingle as the left plate advances beneath the shingle.

Having described my invention, I claim:

1. A roof shingle stripping device for removing a shingle from a roof, comprising:

an elongated body means having an upper end and a lower end;

handle means mounted on the upper end of the body means;

a lift plate having a leading, lifting edge and a heel;

pivot means connecting the lower end of the body means to the lifting plate such that by swinging the handle means about the pivot means, the lifting plate may be pivoted about said heel to raise the shingle from the roof; and piston and cylinder power means having a piston rod and mounted on the body means, and including linkage means pivotally connected between the body means and the lifting plate and to the power means such that the power means is operative to pivot the lifting plate with respect to the body means.

2. A roof stripping apparatus as defined in claim 1, in which the pivot means is mounted on the top of the lift plate, and the heel comprises structure mounted beneath the lift plate between the pivot means and the leading edge of the lift plate.

3. A roof stripping apparatus as defined in claim 1, in which the linkage means include first, second and third link members, the first link member being connected to the body means, the second link member being connected to the lift plate, and the third lift member being connected to the piston rod, and including pivot means connecting the opposite end of each of said first, second and third links together in such a manner that as the piston rod is being moved in one direction, the second and the third links are folded so as to pivot the lift plate with respect to the body means.

4. A roof stripping apparatus as defined in claim 1, in which the leading edge of the lift plate has an open-end slot for receiving a roofing nail.

5. A roof stripping apparatus as defined in claim 1, including trigger means mounted on the handle operative to energize the power means.

6. A roof stripping apparatus as defined in claim 1, including a shield mounted on the top of the lift plate adjacent the pivot means for guiding a shingle being removed from the roof by the lift plate.

7. A roof shingle stripping apparatus for removing a shingle from a roof, comprising:

elongated body means having an upper end and a lower end;

handle means mounted on the upper end of the body means;

a lift plate having a leading edge suited for insertion beneath the roof shingle, the lift plate having a trailing edge spaced from the leading edge;

heel structure mounted beneath the lift plate between the leading edge and the trailing edge thereof such that when the heel structure is mounted on the roof, the leading edge may be rocked about the heel structure to raise the shingle;

pivot means connecting the lower end of the body means to the lift plate for pivotal motion;

piston and cylinder power means mounted on the body means;

a pair of links, including a first link pivotally connected to the lift plate, and a second link pivotally connected to the body means, and means pivotally connecting the piston and cylinder power means to the first and second links to form a toggle mechanism such that the first and second links are movable with respect to one another in a toggle motion in a direction depending upon the motion of the piston and cylinder power means, whereby, when the piston and cylinder power means is actuated to move the first and second links in a toggle motion, the lift plate is pivoted with respect to the body means to rock the lift plate about the heel structure to raise the shingle from the roof.

8. A roof shingle stripping apparatus as defined in claim 7, in which the first link is pivotally connected to the lift plate in a position adjacent the trailing edge thereof.

* * * * *